US007982729B2

(12) United States Patent
Chen et al.

(10) Patent No.: US 7,982,729 B2
(45) Date of Patent: Jul. 19, 2011

(54) DRIVING SIGNAL GENERATING DEVICE AND RELATED METHOD FOR DISPLAY DEVICE

(75) Inventors: Jiun-Ting Chen, Hsin-Chu Hsien (TW); Wen-Ping Chou, Hsin-Chu Hsien (TW); Feng-Jung Kuo, Hsinchu County (TW); Kuei-Chung Chang, Hsinchu County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 795 days.

(21) Appl. No.: 11/751,612

(22) Filed: May 21, 2007

(65) Prior Publication Data

US 2008/0174536 A1 Jul. 24, 2008

(30) Foreign Application Priority Data

Jan. 24, 2007 (TW) ..... 96102673 A

(51) Int. Cl.
*G09G 3/36* (2006.01)

(52) U.S. Cl. ..... 345/208; 345/89

(58) Field of Classification Search ..... 345/53, 345/89, 94, 97, 99, 101, 208, 690–692, 58
See application file for complete search history.

(56) References Cited

U.S. PATENT DOCUMENTS

| | | | | |
|---|---|---|---|---|
| 6,538,629 | B1 * | 3/2003 | Ito | 345/89 |
| 2003/0156128 | A1 * | 8/2003 | Ito | 345/690 |
| 2005/0017991 | A1 * | 1/2005 | Yamazaki et al. | 345/690 |

* cited by examiner

*Primary Examiner* — Chanh Nguyen
*Assistant Examiner* — Allison Walthall
(74) *Attorney, Agent, or Firm* — Winston Hsu; Scott Margo

(57) ABSTRACT

A driving signal generating device for staggering transition time of driving signals to prevent image crosstalk for a display device includes a receiving terminal, a first adjusting unit, a multiplexer, a second adjusting unit and a frame output controller. The receiving terminal receives a plurality of step grayscale waveforms. The first adjusting unit transforms the plurality of step grayscale waveforms into a plurality of initial grayscale waveforms and further adjusts widths of the plurality of initial grayscale waveforms according to a first predetermined value to generate a plurality of grayscale waveforms. The multiplexer selects a first grayscale waveform from the plurality of grayscale waveforms. The second adjusting unit then adjusts a width of the first grayscale waveform according to a second predetermined value to generate a second grayscale waveform. The frame output controller controls output of the first grayscale waveform and the second grayscale waveform.

15 Claims, 10 Drawing Sheets

DRIVING SIGNAL GENERATING DEVICE AND RELATED METHOD FOR DISPLAY DEVICE

BACKGROUND OF THE INVENTION

1. Field of the Invention

The present invention relates to a circuit device and related method for a display device, and more particularly, to a driving signal generating device for staggering transition time of driving signals to prevent image crosstalk for a display device.

2. Description of the Prior Art

With vigorous growth in electronic industrials, a liquid crystal display (LCD) has been widely used in various application fields and the market demand thereof has been increasing rapidly. The operating principle of the LCD is that the LCD utilizes different voltages to drive liquid crystals to arrange in different aspects so as to control the light penetrating amount for each pixel of an image. According to driving manners, the LCD can be divided into three types: Static, Simple Matrix and Active Matrix. The simple matrix type is called a passive type as well, having two models of twisted nematic (TN) and super twisted nematic (STN). The passive TN and STN LCDs both utilize field voltages to drive the liquid crystals so that response times corresponding to central pixels of the panel may become longer with increase of the panel size, affecting image quality. In addition, the TN and STN LCDs have simple architecture and thus are applied to small-size, low-resolution applications, such as electronic dictionaries, mobile phones, personal digital assistants (PDAs), and electronic manometers.

Please refer to FIG. 1, which is a block schematic diagram of a passive LCD 10 according to the prior art. The LCD 10 includes a driving signal generating device 12, a panel 14, a segment electrode driver 16 and a common electrode driver 18. The panel 14 includes segment electrodes SEG1-SEGN and common electrodes COM1-COMK to form multiple intersections each representing a pixel of an image. The operating principle of the passive LCD 10 to drive the panel 14 is that the segment electrode driver 16 transfers driving signals with respect to pixel data to the segment electrodes SEG1-SEGN and moreover cooperates with the timing that the common electrode driver 18 switches on the common electrode. The liquid crystals of each pixel in response to the driving signals twist to certain expected angles and thereby different light amounts are distributed for each pixel according to image data. An image can thus be displayed on the panel 14. In general, an image is displayed, line-by-line, on the screen of the LCD 10. That is, the common electrode driver 18 switches on the common electrode COM1-COMK in sequence, whereas the segment electrode driver 16 accordingly transfers driving signals for pixels of each common electrode. The driving signal generating device 12 is utilized to generate the driving signals for the segment electrode driver 16.

Please refer to FIG. 2, which is a block diagram of the driving signal generating device 12 according to FIG. 1. The driving signal generating device 12 includes a waveform generator 200, a gamma table generator 210, a memory 220 and a multiplexer 230. The waveform generator 200 generates multiple step grayscale waveforms according to a clock signal. For instance, assuming that the display device 10 has thirty gray scales, the waveform generator 200 will be able to generate thirty step grayscale waveforms each corresponding to one of the thirty gray scales. The gamma table generator 210 determines widths of the step grayscale waveforms according to a gamma setting signal SGM, so as to generate grayscale waveforms GW1-GW30. The grayscale waveforms GW1-GW30 are driving signals with different waveform widths, each corresponding to a grayscale value. The memory 220 stores pixel data of each image. The multiplexer 230 selects one of the grayscale waveforms GW1-GW30 for every pixel according to a control signal SSD generated by the memory 220, and outputs the selected grayscale waveform to the segment electrode driver 16. Via the control signal SSD, the driving signal generating device 12 is allowed to transform a pixel value to a grayscale waveform.

Since the liquid crystals may lose flexibility of polarization under long-term driving by same voltage, the display device requires voltage signals having different polarities to drive the liquid crystals when an image is displayed in continuous frames. Please refer to FIG. 3 and FIG. 4, which are signal waveforms of partial pixels of the display device 10 in frames F1-F4. As can be seen from FIGS. 3 and 4, an image includes the frames F1-F4 for use with driving voltage having positive and negative polarities, labeled with + and −. Four pixels are intersections of the segment electrode SEG1 and the common electrodes COM1-COM4, whereas the other four pixels are intersections of the segment electrode SEG2 and the common electrodes COM1-COM4. Assume that the eight pixels have the same grayscale value, and the corresponding grayscale waveforms thereof are one of the grayscale waveforms GW1-GW30. Thus, the pixels corresponding to the segment electrodes SEG1 and SEG2 are corresponding to the same grayscale waveform in each frame. For example, in the frame F1, the grayscale waveforms of the pixel (SEG1 versus COM1) and the pixel (SEG2 versus COM1) fall from high to low (falling time) at the same time and rise from low to high (rising time) at the same time as well.

If the grayscale waveforms of the neighboring pixels have identical transition time (falling time or rising time), crosstalk happens between the neighboring segment electrodes. The grayscale waveforms of the neighboring segment electrodes interact with each other, resulting in inaccurate display of grayscale values and line effects of images. Moreover, the grayscale waveforms are not perfect in implementation and thereby react to transitions (rising or falling) with response times. Therefore, the neighboring segment electrodes will simultaneously demand transition current if the neighboring pixels have the same grayscale value. This challenges system circuits and due to huge workload, the response time may be extended, increasing root-mean-square (RMS) loss of transition current. On the other hand, supposing that the grayscales of all pixels in FIG. 3 and FIG. 4 are fully black or white, the grayscale waveforms thereof keep at high or low without transitions. In this situation, the fully black or white pixels show stronger grayscale depths than other pixels do due to no current loss, resulting in an unbalanced image.

Therefore, the grayscale waveforms corresponding to the neighboring pixels having the same grayscale value have the same transition time when the prior art display device 10 displays the image. The grayscale waveforms are thus affected by each other such that crosstalk happens between the neighboring segment electrodes, resulting in image distortion.

SUMMARY OF THE INVENTION

It is therefore a primary object of the present invention to provide a driving signal generating device and related method for staggering transition time of driving signals to prevent image crosstalk for a display device.

The present invention discloses a driving signal generating device for staggering transition time of driving signals to prevent image crosstalk for a display device. The driving signal generating device includes a receiving terminal, a first adjusting unit, a multiplexer, a second adjusting unit and a frame output controller. The receiving terminal is utilized to receive a plurality of step grayscale waveforms. The first adjusting unit is coupled to the receiving terminal and used for transforming the plurality of step grayscale waveforms into a plurality of initial grayscale waveforms according to a first control signal and adjusting widths of the plurality of initial grayscale waveforms according to a first predetermined value to generate a plurality of grayscale waveforms. The plurality of initial grayscale waveforms corresponds to a plurality of grayscale values of the display device. The multiplexer is coupled to the first adjusting unit and used for selecting a first grayscale waveform from the plurality of grayscale waveforms according to a second control signal. The second adjusting unit is coupled to the multiplexer and used for adjusting a width of the first grayscale waveform according to a second predetermined value to generate a second grayscale waveform. The frame output controller is coupled to the second adjusting unit and the multiplexer, and used for controlling output of the first grayscale waveform and the second grayscale waveform.

The present invention further discloses a driving signal generating method of staggering transition time of driving signals to prevent image crosstalk for a display device. The driving signal generating method includes the following steps of receiving a plurality of step grayscale waveforms. The plurality of step grayscale waveforms are transformed into a plurality of initial grayscale waveforms according to a first control signal and widths of the plurality of initial grayscale waveforms are adjusted according to a first predetermined value to generate a plurality of grayscale waveforms. The plurality of initial grayscale waveforms corresponds to a plurality of grayscale values of the display device. A first grayscale waveform is selected from the plurality of grayscale waveforms according to a second control signal. Width of the first grayscale waveform is adjusted according to a second predetermined value to generate a second grayscale waveform. The first grayscale waveform and the second grayscale waveform are then outputted.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
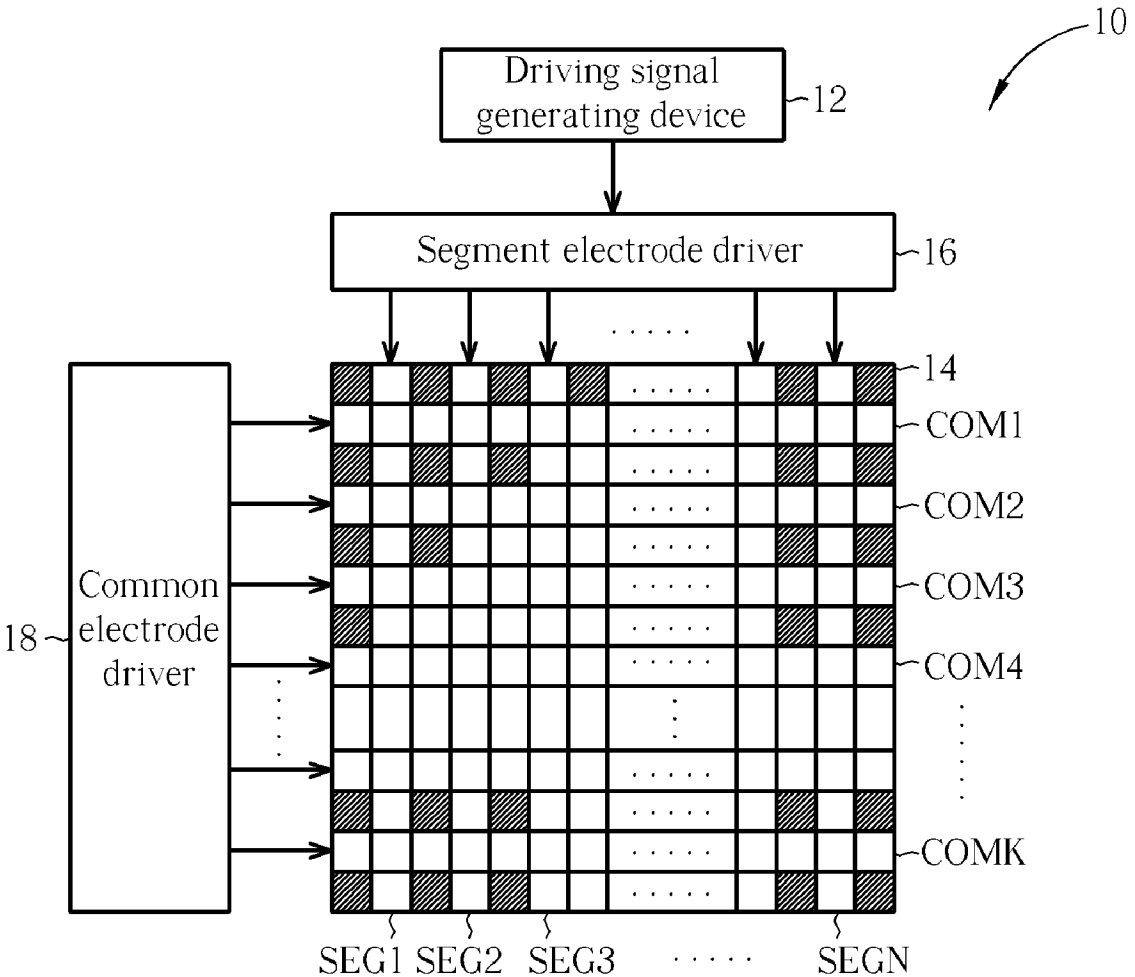
Fig. 1 Prior Art
FIG. 1 is a block schematic diagram of a passive LCD according to the prior art.
Figure 2:
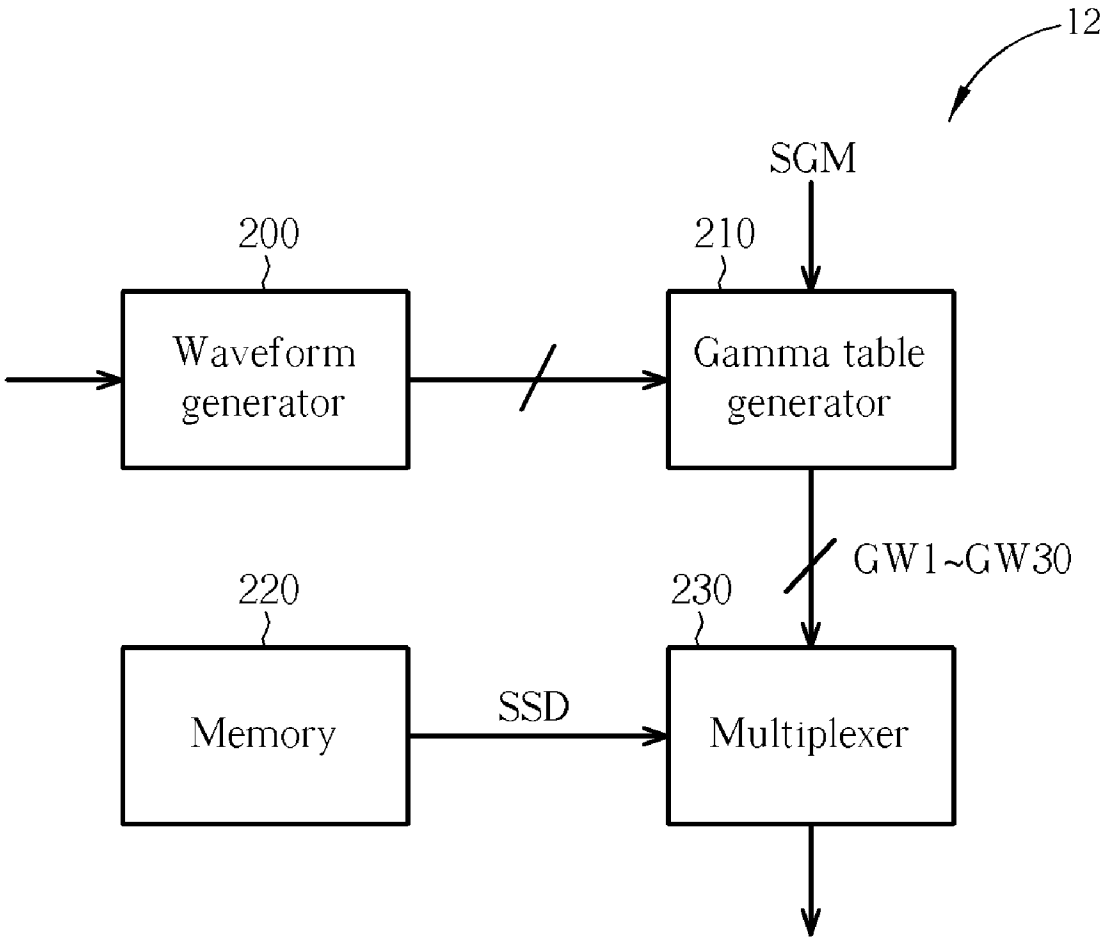
Fig. 2 Prior Art
FIG. 2 is a block diagram of the driving signal generating device according to the passive LCD shown in FIG. 1.
Figure 3:
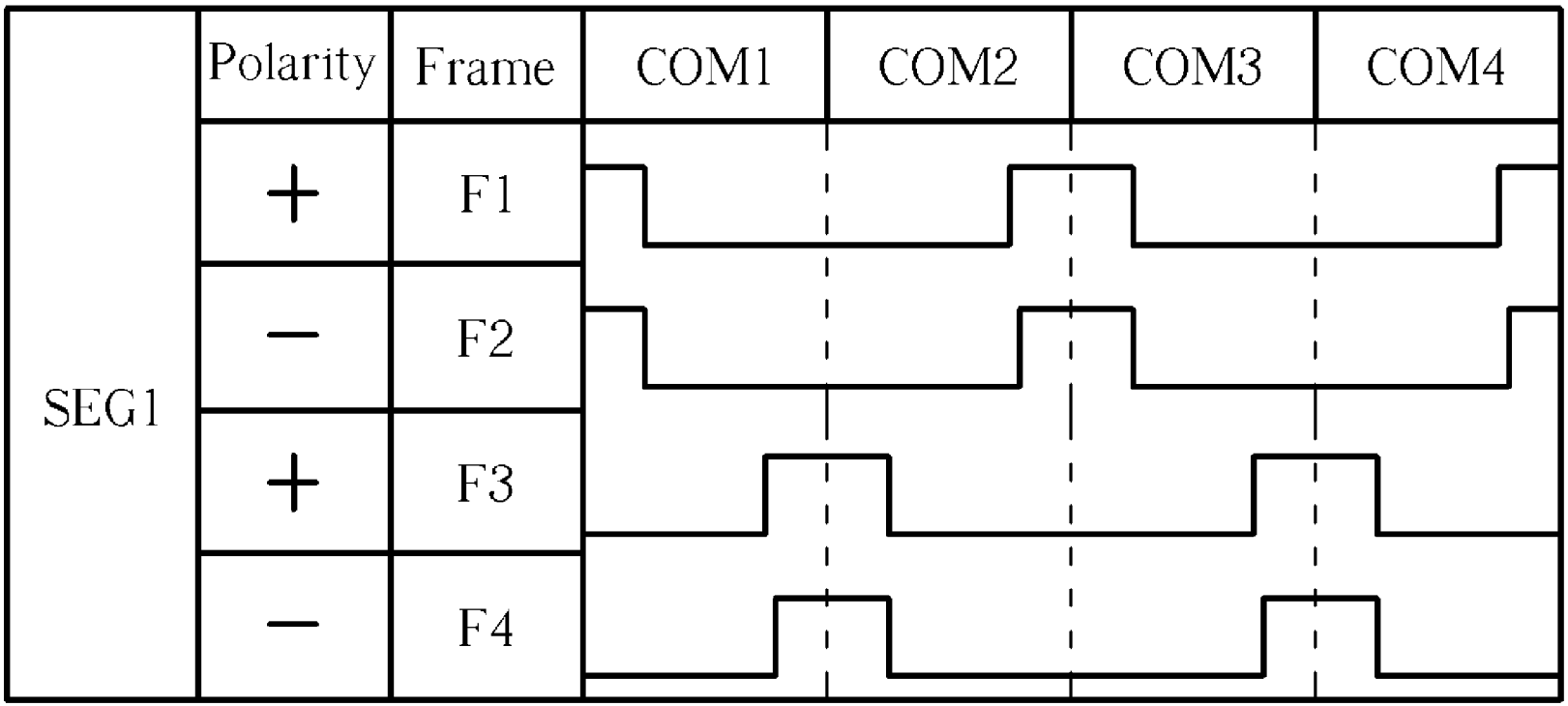
Fig. 3 Prior Art
FIGS. 3-4 are signal waveforms of partial pixels in different frames according to the passive LCD 10 shown in FIG. 1.
Figure 4:
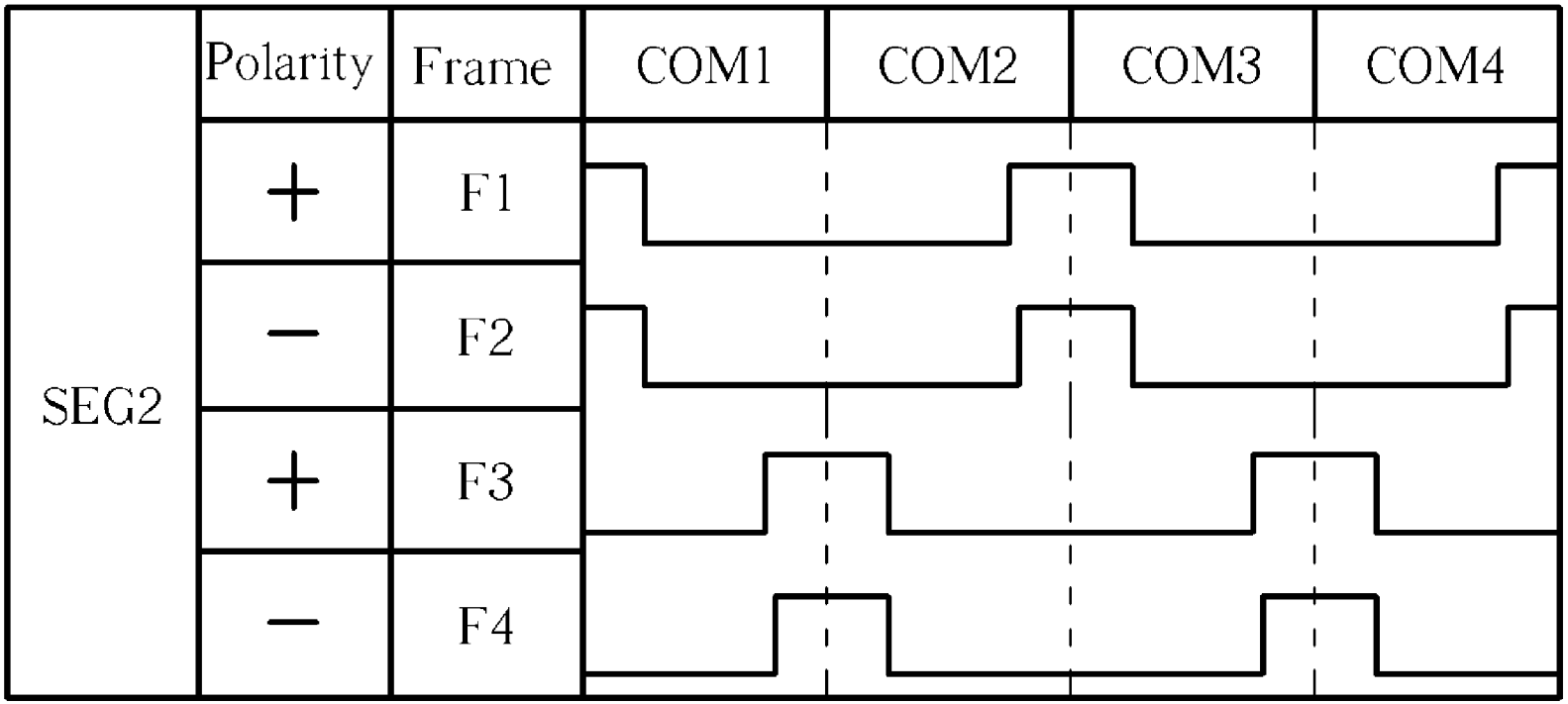
Fig. 4 Prior Art
Figure 5:
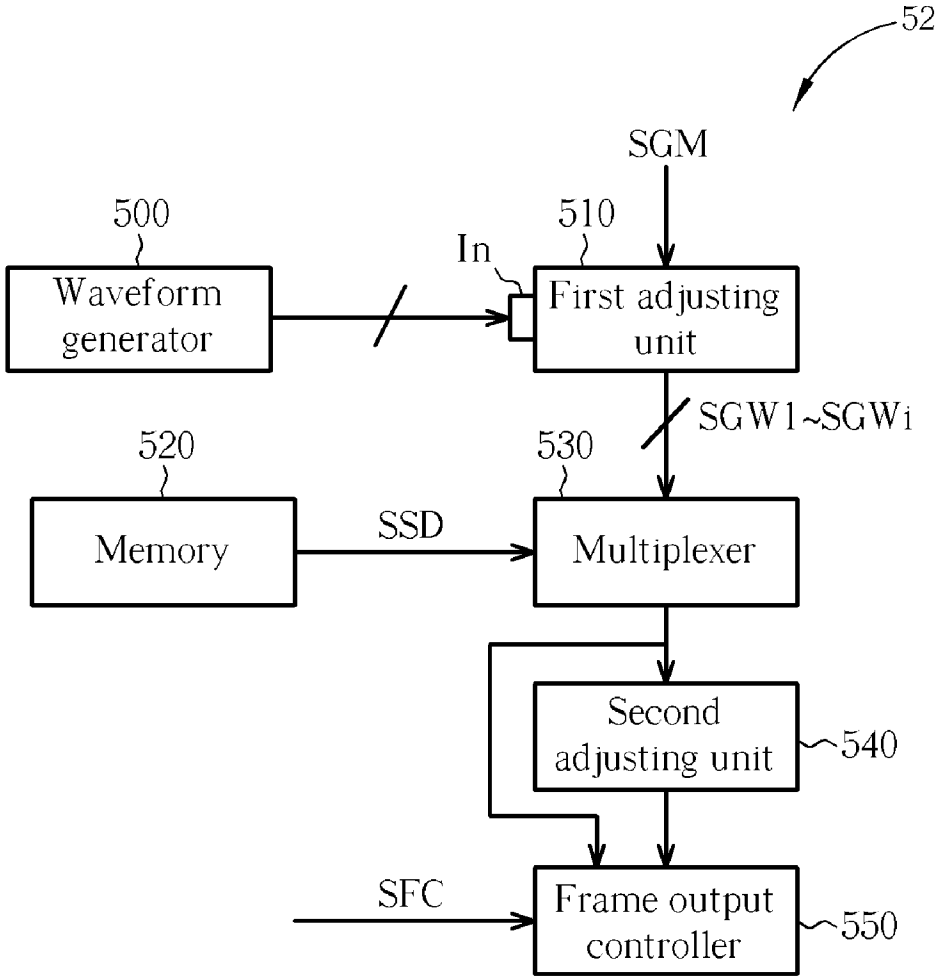
FIG. 5 is a schematic diagram of a driving signal generating device according to an embodiment of the present invention.
Figure 6:
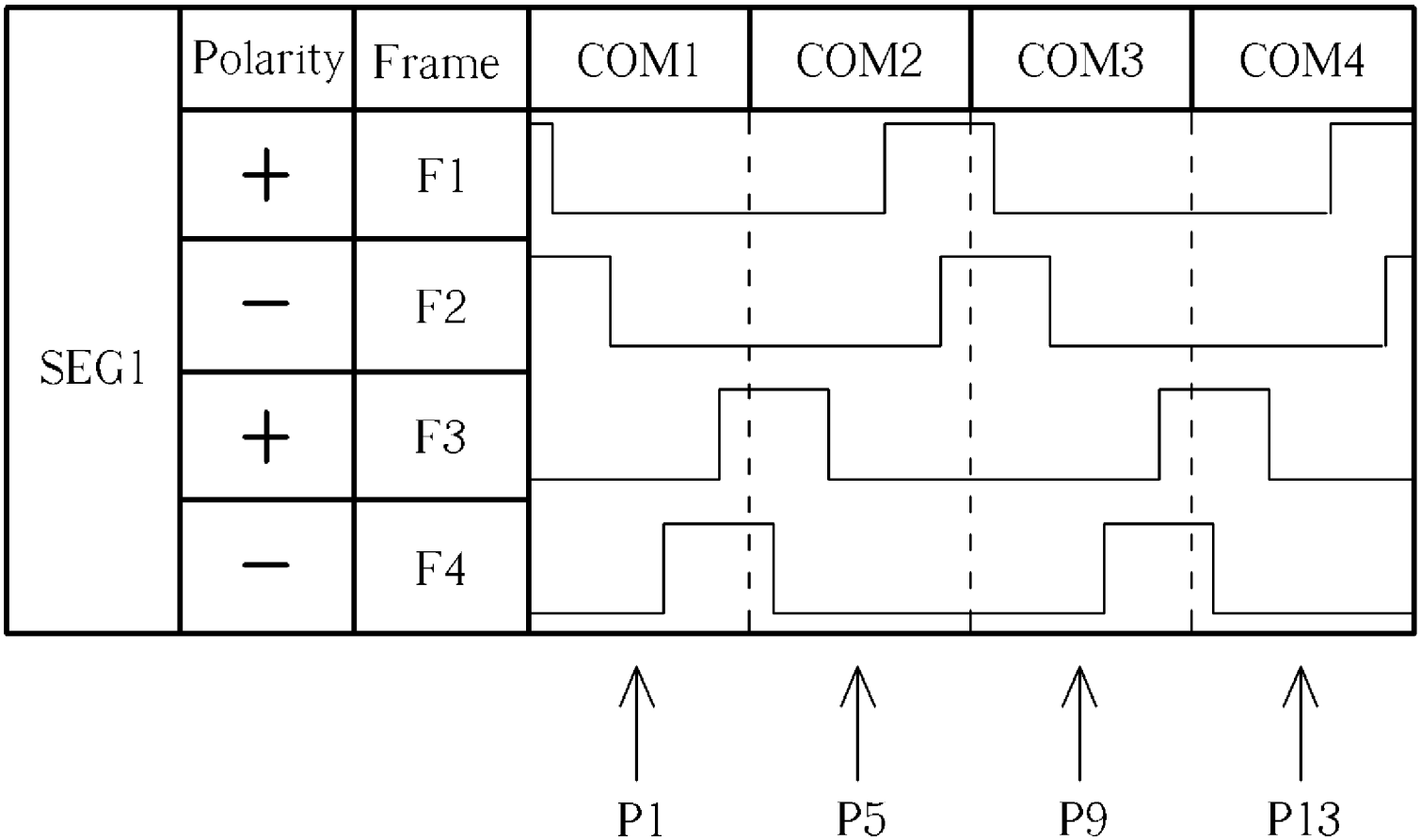
FIGS. 6-9 are signals waveforms of partial pixels in different frames according to the driving signal generating device shown in FIG. 5.
Figure 7:
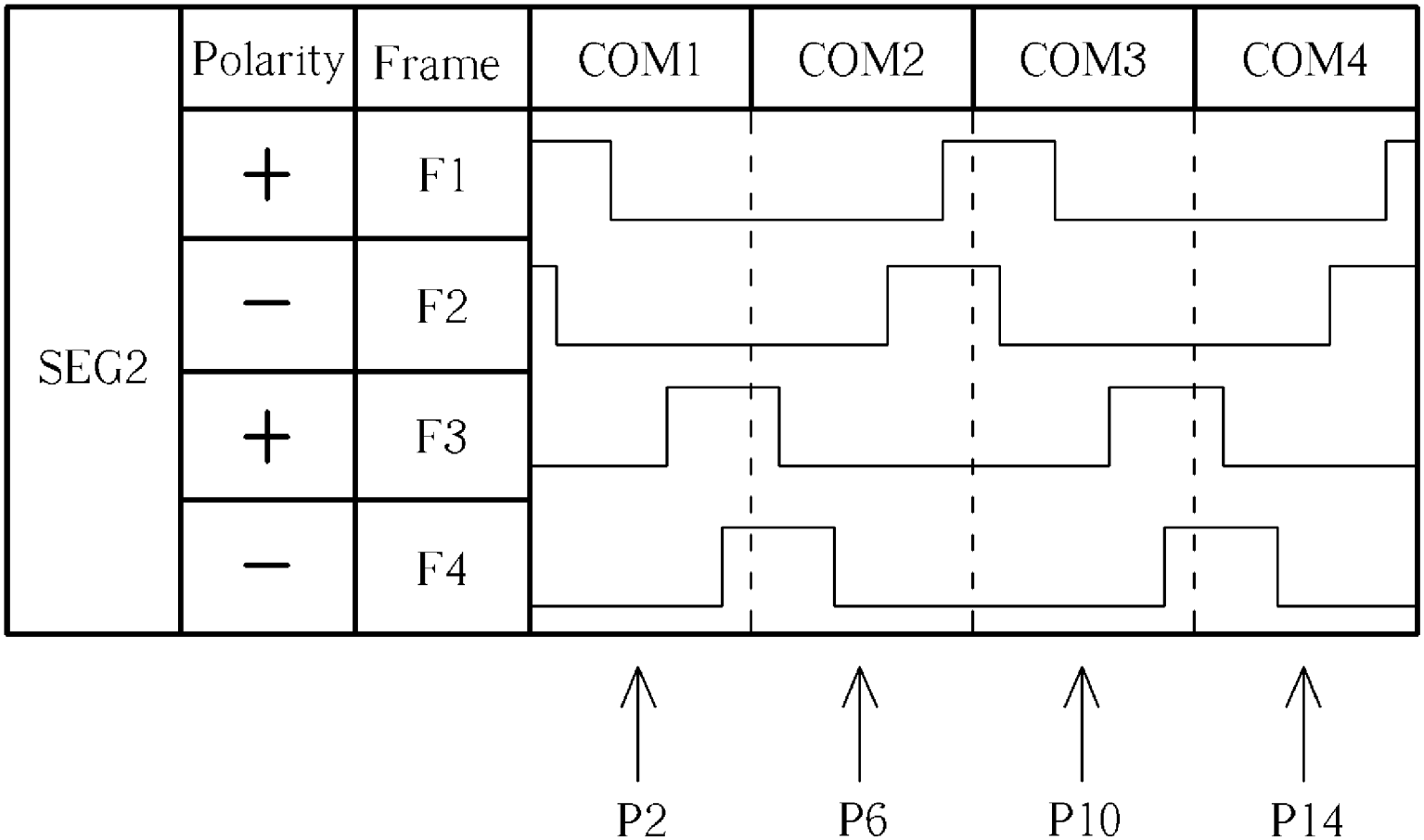
Figure 8:
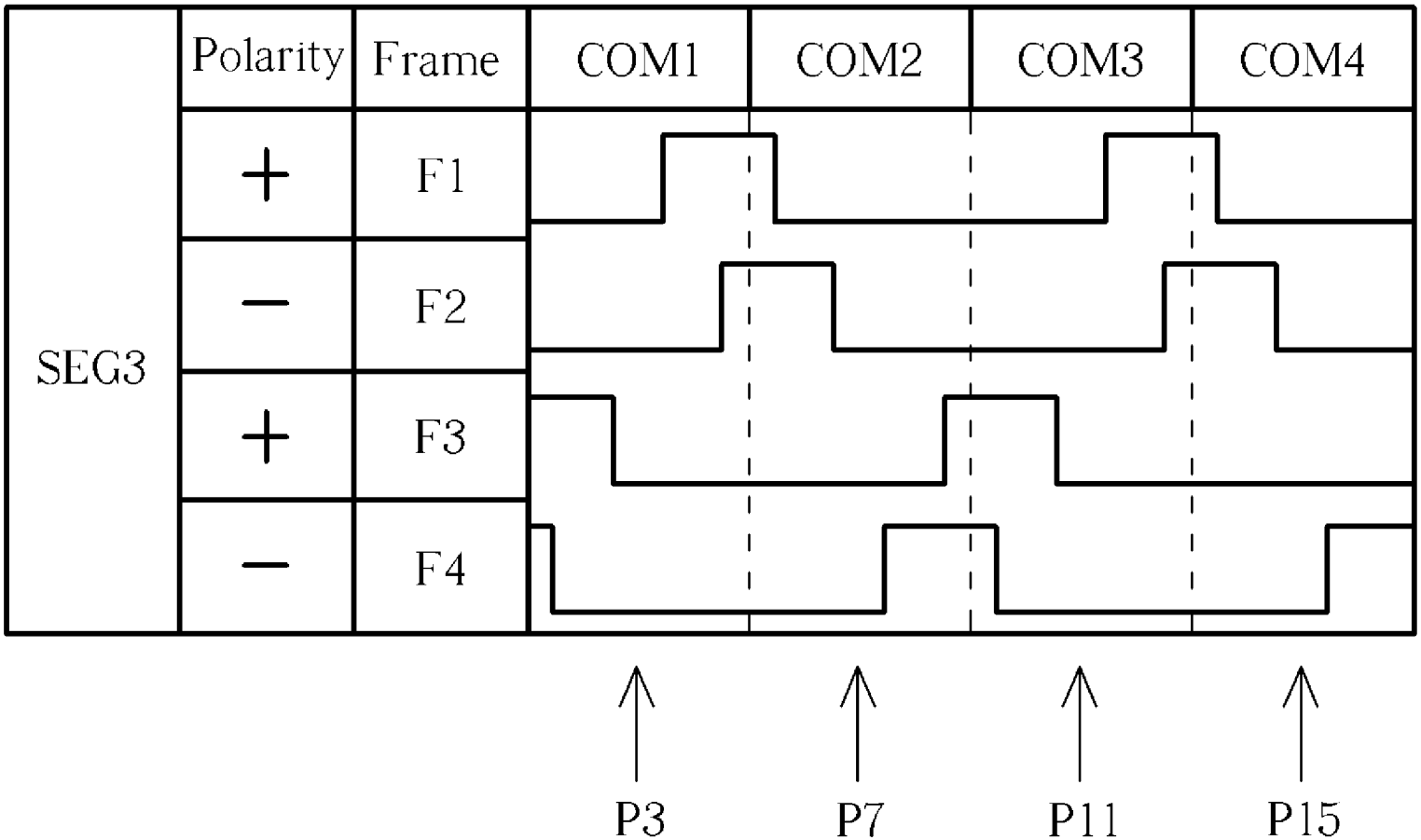
Figure 9:
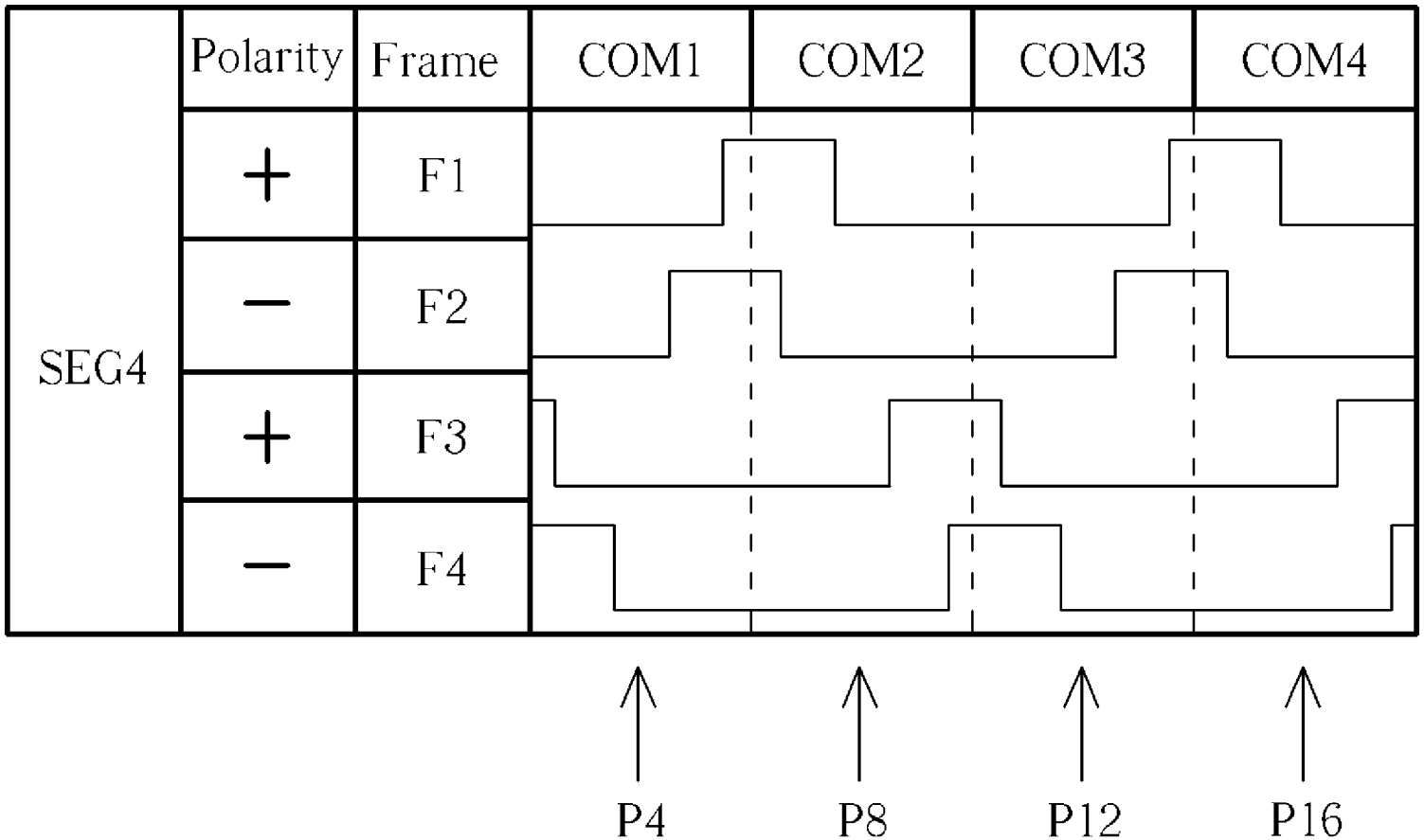

Please refer to FIG. 5, which is a schematic diagram of a driving signal generating device 52 according to an embodiment of the present invention. The driving signal generating device 52 is applied to a passive display device for staggering transition time of driving signals outputted from segment electrodes in the passive display device. The passive display device is capable of displaying i gray scales (assume that the grayscale values are 1–i), and the architecture thereof is similar to that of the display device 10 in FIG. 1. Here, the driving signal generating device 52 is adopted to replace the driving signal generating device 12, and includes a waveform generator 500, a receiving terminal In, a first adjusting unit 510, a memory 520, a multiplexer 530, a second adjusting unit 540 and a frame output controller 550. The receiving terminal In is used for receiving i step grayscale waveforms generated by the waveform generator 500. The first adjusting unit 510 is a gamma table generator and used for transforming the step grayscale waveforms into initial grayscale waveforms GW1-GWi according to a gamma setting signal SGM and adjusting widths of the initial grayscale waveforms GW1-GWi according to a predetermined value V1 so as to generate grayscale waveforms SGW1-SGWi. The initial grayscale waveforms GW1-GWi correspond to the grayscale values 1–i of the passive display device, respectively. The multiplexer 530 is used for selecting a first grayscale waveform from the grayscale waveforms SGW1-SGWi according to a control signal SSD generated by the memory 520. The second adjusting unit 540 is coupled to the multiplexer 530 and is preferably a shift register. The second adjusting unit 540 is used for adjusting a width of the first grayscale waveform according to a predetermined value V2, so as to generate a second grayscale waveform. The predetermined value V2 is exemplarily set to be twice the predetermined value V1 for staggering the transition time and also maintaining the image quality. The frame output controller 550 is coupled to the second adjusting unit 540 and the multiplexer 530, and used for controlling output of the first grayscale waveform and the second grayscale waveform. According to a control signal SFC, the frame output controller 550 determines output order of the first grayscale waveform and the second grayscale waveform.

For example, assume that the display device can display 30 gray scales (i=30 and the initial grayscale waveforms has 30 instances, represented by GW1-GW30. Each image is displayed by four continuous frames stored in the memory 520, and grayscale values of sixteen pixels in each frame are all corresponding to the initial grayscale waveform GW15. The sixteen pixels of each frame are intersections of the segment electrodes SEG1-SEG4 and the common electrodes COM1-COM4. The predetermined value V1 is set to 1 whereas the predetermined value V2 is set to 2 accordingly. Thus, according to the predetermined value V1, the first adjusting unit 510 decreases the widths of the initial grayscale waveforms GW1-GW30 by one unit waveform width to generate the grayscale waveforms SGW1-SGW30 after the first adjusting unit 510 generates the initial grayscale waveforms GW1-GW30.

In this situation, the widths of the grayscale waveforms SGW1-SGW30 are identical to those of the initial grayscale waveform GW1 and the initial grayscale waveforms GW2-GW29, respectively. The grayscale waveform SGW1 represents a grayscale value of full black so that the grayscale value cannot be decreased any more. Accordingly, the width of the grayscale waveform SGW1 needs no modification. As can be known from the above, the grayscale waveform SGW15 has the same width as the initial grayscale waveform GW14, but not the initial grayscale waveform GW15 any more. This indicates that the grayscale waveform SGW15 is corresponding to a smaller grayscale value after the adjustment of the width. Thus, for the display of a pixel interlaced by the segment electrode SEG1 and the common electrode COM1, the memory 520 first reads the grayscale value of the pixel, corresponding to the initial grayscale waveform GW15, and thereby generates the control signal SSD for the multiplexer 530. The multiplexer 530 selects the grayscale waveform SGW15 from the grayscale waveforms SGW1-SGW30 according to the control signal SSD. Since the predetermined value V2 is 2, the second adjusting unit 540 increases the width of the grayscale waveform SGW15 by two unit waveform widths, so as to generate the grayscale waveform W2 whose width is identical to that of the initial grayscale waveform GW16. At last, the frame output controller 550 determines which of the grayscale waveform SGW15 and the grayscale waveform W2 should be outputted in each of the four frames according to the control signal SFC, and thereby transfers the required grayscale waveform to the segment electrode driver 56.

Therefore, to display data for a pixel, the driving signal generating device 52 slightly decreases the grayscale value of the pixel, increases the decreased grayscale value in double quantity, and alternately outputs the decreased and increased grayscale values for the frames. Take the foregoing example, if the pixel has a grayscale value of 15, the driving signal generating device 52 subsequently generates two grayscale waveforms, corresponding to grayscale values of 14 and 16, for the pixel. The grayscale waveforms are alternately outputted to four frames in display of an image, where the output order of the grayscale waveforms is 14→16→14→16, preferably. Thus, the driving signal generating device 52 can stagger transition time of signals of the pixel for each frame because of different widths of the grayscale waveforms corresponding to the grayscale values of 14 and 16. In addition, the driving signal generating device 52 can maintain the original image quality with alternation of the grayscale waveforms since the time average of the grayscale value for the pixel is the same as the original grayscale value of the pixel, calculated by the equation (14+16+14+16)/4=15. Therefore, the driving signal generating device 52 can stagger transition time of driving signals without losing image quality to prevent crosstalk of the segment electrodes.

Note that, those skilled in the art can do modifications for adjustment of the above-mentioned waveforms in the embodiment of the present invention. For example, the first adjusting unit 510 has an alternative of decreasing the widths of the initial grayscale waveforms GW2-GW30, except for the initial grayscale waveforms GW1 corresponding to the minimum grayscale value, which is 1. Besides, the first adjusting unit 510 can first increase the widths of the initial grayscale waveforms, and thereby the second adjusting unit 540 decreases the width of the selected grayscale waveform, achieving acceptable distortion of image displaying as well. Similar to the former case, the widths of the initial grayscale waveforms GW1-GW29 can be adjusted by the first adjusting unit 510 except for the width of the initial grayscale waveform GW30 corresponding to the maximum grayscale value, which is i. Additionally, those skilled in the art can do scale or allocation modifications for the unit value of the grayscale or the unit waveform width according to different specifications of the passive display device. The predetermined values V1, V2 and the frame amount of each image can be modified as well, but the predetermined value V1, V2 cannot be so large as to affect the image quality.

Please refer to FIGS. 6-9, which are signals waveforms of the segment electrodes SEG1-SEG4 in frames F1-F4 according to FIG. 5. More specifically, FIGS. 6-9 depicts the grayscale waveforms corresponding to pixels P1-P16 intersected by the segment electrodes SEG1-SEG4 and the common electrodes COM1-COM4. As mentioned above, the passive display device has thirty grayscale values, and each pixel of the segment electrodes SEG1-SEG4 shown in FIGS. 6-9 has a predetermined grayscale value of 15. As can be seen in FIGS. 6-9, the pixels P1-P4 in the frame F1 have the grayscale waveforms corresponding to grayscale values of 14, 16, 14 and 16, respectively. Obviously, the transition times of the grayscale waveforms of the pixels P1-P4 are staggered, and those of the pixels P5-P8, P9-P12 and P13-P16 are staggered as well. Thus, the neighboring pixels distributed on the segment electrodes SEG1-SEG4 have asynchronous transition time even if having the same predetermined grayscale value. This can avoid interactions between the grayscale waveforms, or the driving signals, of the segment electrodes SEG1-SEG4, where the interactions can result in image distortion. In addition, according to FIGS. 6-9, the grayscale value of each pixel revealed from the frame F1 to F4 has a time average of 15, such as the time average value of the pixel P5 is calculated by the equation (16+14+16+14)/4=15. For a pixel, displaying a pixel with slightly different grayscale values in different frames alternately can make human eyes insensitive to image variation and also achieves undistorted image quality. Please note that the above-mentioned instance is one of the embodiments of the present invention, and those skilled in the art can do modifications on allocation of pixels, the segment electrodes and the common electrodes.

Figure 10:
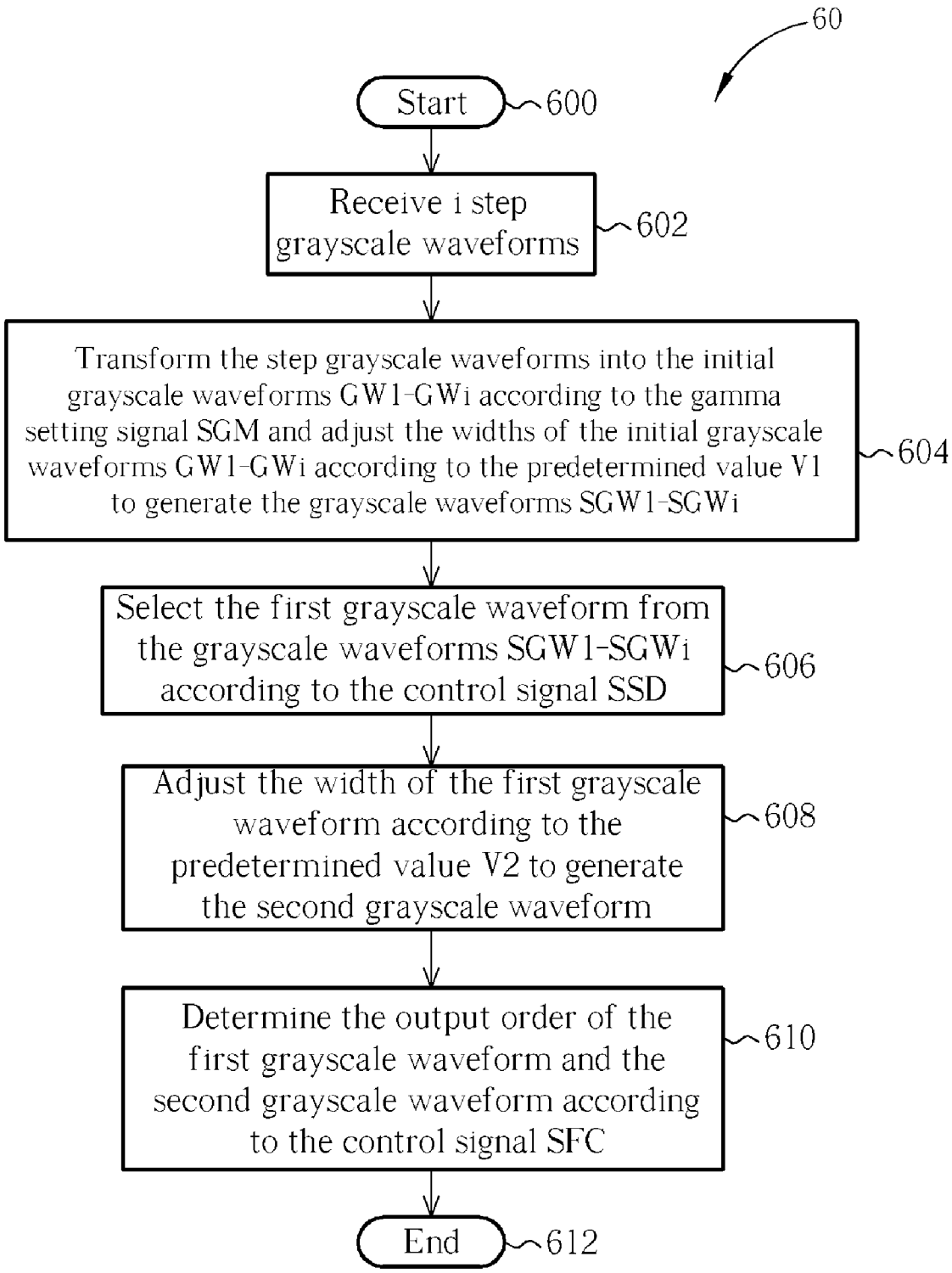
FIG. 10 is a flowchart of a process according to an embodiment of the present invention.

Speaking of the operating process of the driving signal generating device 52, please refer to FIG. 10, which is a flowchart of a process 60 according to an embodiment of the present invention. The process 60 is utilized to realize the functions of the driving signal generating device 52 for staggering transition time of driving signals to prevent crosstalk between the segment electrodes. The process 60 includes the following steps:

Step 600: Start.

Step 602: Receive i step grayscale waveforms.

Step 604: Transform the step grayscale waveforms into the initial grayscale waveforms GW1-GWi according to the gamma setting signal SGM and adjust the widths of the initial grayscale waveforms GW1-GWi according to the predetermined value V1 to generate the grayscale waveforms SGW1-SGWi, where the initial grayscale waveforms GW1-GWi correspond to the grayscale values 1–i of the display device, respectively.

Step 606: Select the first grayscale waveform from the grayscale waveforms SGW1-SGWi according to the control signal SSD.

Step 608: Adjust the width of the first grayscale waveform according to the predetermined value V2 to generate the second grayscale waveform.

Step 610: Determine the output order of the first grayscale waveform and the second grayscale waveform according to the control signal SFC.

Step 612: End.

Accordingly, the process 60 generates two grayscale waveforms each corresponding to a grayscale value according to the original grayscale value of a pixel. One grayscale value is larger than the original grayscale value whereas the other is smaller than original. Thus, the grayscale waveforms outputted to the segment electrode driver have different widths so that the neighboring segment electrodes can stagger their transition times when the neighboring pixels is displayed, preventing image crosstalk. Moreover, by alternately outputting the grayscale waveforms based on slightly different grayscale values to the continuous frames, the human eyes hardly sense variation of the image and feel as if the image is undistorted.

Note that, those skilled in the art can do modifications on the process 60. For example, the widths of the initial grayscale waveforms are increased first, except for the initial grayscale waveform corresponding to the maximum grayscale value, and then the grayscale waveforms selected are subsequently decreased of the width. Further, the scale of the unit grayscale value, the determined values V1, V2 and an amount of frames for an image can also be modified according to the requirements of the display device.

In summary, in the prior art display device, in the case that the pixels locating on the neighboring segment electrodes and the same common electrode have the same grayscale value to display, the grayscale waveforms used to drive the liquid crystals of the pixels have an identical waveform width. As a result, crosstalk occurs between the neighboring segment electrodes, reducing image vividness. Compared with the prior art, the embodiment of the present invention generates two grayscale values for each pixel, one larger than its original grayscale value and the other smaller than the original. As a result, there is no crosstalk between the neighboring segment electrodes due to staggered transition times of the grayscale waveforms. Additionally, an advantage of staggering transition times can reduce rising and falling time of the grayscale waveforms, thereby decreasing RMS loss of the grayscale values. Moreover, the grayscale waveforms having slightly different grayscale values are also alternately used for each pixel in neighboring frames, or in time domain. As for fully black or fully white pixels, their grayscale waveforms are slightly changed to have transition times so that the whole image have the same RMS grayscale value. The fully black or fully white pixels will not be shown in stronger denseness than other pixels, resulting in unbalanced grayscale depths. Therefore, the present invention has advantages of easy implementation, small area, and enhancing image quality.

Those skilled in the art will readily observe that numerous modifications and alterations of the device and method may be made while retaining the teachings of the invention.

What is claimed is:

1. A driving signal generating device for staggering transition time of driving signals to prevent image crosstalk for a display device, the driving signal generating device comprising:

a receiving terminal for receiving a plurality of step grayscale waveforms;

a first adjusting unit coupled to the receiving terminal, for transforming the plurality of step grayscale waveforms into a plurality of initial grayscale waveforms according to a first control signal and adjusting widths of the plurality of initial grayscale waveforms according to a first predetermined value to generate a plurality of grayscale waveforms, where the plurality of the initial grayscale waveforms corresponds to a plurality of grayscale values of the display device;

a multiplexer coupled to the first adjusting unit, for selecting a first grayscale waveform from the plurality of grayscale waveforms according to a second control signal;

a second adjusting unit coupled to the multiplexer, for adjusting a width of the first grayscale waveform according to a second predetermined value to generate a second grayscale waveform; and a frame output controller coupled to the second adjusting unit and the multiplexer, for controlling output of the first grayscale waveform and the second grayscale waveform.

2. The driving signal generating device of claim 1, wherein the frame output controller further determines output order of the first grayscale waveform and the second grayscale waveform according to a third control signal.

3. The driving signal generating device of claim 1, wherein the first adjusting unit is a gamma table generator of the display device.

4. The driving signal generating device of claim 1 further comprising a waveform generator coupled to the receiving terminal, for generating the plurality of step grayscale waveforms.

5. The driving signal generating device of claim 4, wherein the first adjusting unit determines widths of the plurality of step grayscale waveforms according to the first control signal to generate the plurality of initial grayscale waveforms.

6. The driving signal generating device of claim 1, wherein the first adjusting unit decreases the widths of the plurality of initial grayscale waveforms according to the first predetermined value.

7. The driving signal generating device of claim 6, wherein the second adjusting unit increases the width of the first grayscale waveform according to the second predetermined value.

8. The driving signal generating device of claim 1, wherein the first adjusting unit decreases the widths of the plurality of initial grayscale waveforms, except for the width of one of the plurality of initial grayscale waveforms that is corresponding to a minimum grayscale value of the plurality of grayscale values of the display device, according to the first predetermined value.

9. The driving signal generating device of claim 8, wherein the second adjusting unit increases the width of the first grayscale waveform according to the second predetermined value.

10. The driving signal generating device of claim 8, wherein the second adjusting unit decreases the width of the first grayscale waveform according to the second predetermined value.

11. The driving signal generating device of claim 1, wherein the first adjusting unit increases the widths of the plurality of initial grayscale waveforms according to the first predetermined value.

12. The driving signal generating device of claim 1, wherein the first adjusting unit increases the widths of the plurality of initial grayscale waveforms, except for the width of one of the plurality of initial grayscale waveforms that is corresponding to a maximum grayscale value of the plurality of grayscale values of the display device, according to the first predetermined value.

13. The driving signal generating device of claim 12, wherein the second adjusting unit decreases the width of the first grayscale waveform according to the second predetermined value.

14. The driving signal generating device of claim 1, wherein the second predetermined value is twice as large as the first predetermined value.

15. The driving signal generating device of claim 1, wherein the second adjusting unit is a shift register.

* * * * *